US006533397B2

(12) United States Patent
Oishi

(10) Patent No.: US 6,533,397 B2
(45) Date of Patent: Mar. 18, 2003

(54) IMAGE FORMING APPARATUS

(75) Inventor: Chikashi Oishi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/972,941

(22) Filed: Oct. 10, 2001

(65) Prior Publication Data

US 2002/0041311 A1 Apr. 11, 2002

(30) Foreign Application Priority Data

Oct. 10, 2000 (JP) ..... 2000-309361
Dec. 22, 2000 (JP) ..... 2000-391240

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,984,456 A * 11/1999 Bern ..... 347/55
6,070,966 A * 6/2000 Desie et al. ..... 347/55
6,109,731 A * 8/2000 Van Gemert et al. ..... 347/55
6,364,463 B1 * 4/2002 Mizuyama et al. ..... 347/55

* cited by examiner

*Primary Examiner*—Raquel Yvette Gordon
(74) *Attorney, Agent, or Firm*—Sughrue Mion, PLLC

(57) ABSTRACT

An ink-jet image forming apparatus comprising: a piezoelectric ink jetting head for ejecting ink droplets, the ink comprising electrically charged particles dispersed in a solvent; ink-supplying means for supplying the ink to the ink jetting head; particle distribution-controlling means for controlling concentration distribution of the particles in the ink at the ink jetting head; and supporting and transporting means for supporting and transporting an image-receiving sheet that receives flying ink droplets ejected from the ink jetting head.

17 Claims, 3 Drawing Sheets

IMAGE FORMING APPARATUS

FIELD OF THE INVENTION

The present invention relates to an ink-jet recording apparatus ejecting ink by means of a piezoelectric element, and in more particular to an ink-jet recording apparatus using such an ink whose particles are dispersed in a solvent.

BACKGROUND OF THE INVENTION

As recording systems having now been practiced, there are a laser recording electrophotographic system, an LED recording electrophotographic system, an impact dot matrix recording system, a thermosensitive recording paper system, a silver halide film recording system, a thermal wax recording system, a thermal dye transfer system, and an ink-jet recording system.

Among them, the ink-jet recording system requires neither a transfer of toner nor a developing process as the electrophotographic system, and this is possible to be miniaturized in a recording system because a recording head has a small size, and to be less in noises because of being not an impact type, and this system has broadly been practiced since copying is possible on plain papers.

Prior ink-jet recording systems include a system using a piezoelectric element deformed in response to electric signals, another using a heating resistor heating in response to electric signals and causing an ink to fly via pressure of boiling by heating, and a further system using electrostatic force by electric signals. The ink-jet recording system using electrostatic force by electric signals is involved with a problem described in Report Magazine of Electronic Communication Associate, '83/1 vol. J66-C, No. 1, p. 51 that if a distance between recording electrodes is narrow owing to interference of electric fields between adjacent channels, a displacing amount in a position of a pixel is made large.

Therefore, a method, which in spite of a distance between the recording electrodes being narrow, the displacing amount in the position of the recording pixel is not made large, has been developed (JP-W-10-501490) (the term "JP-W" as used herein means an "a published Japanese national stage of international application"). This is such a method of separating ink droplets selected from an ink main body within the printing apparatus by electrostatic induction force. This method supplies a certain electric potential to a printing head and supplies another electric potential to a platen located in opposition to the recording medium so as to generate an electric field, and since it is unnecessary to modulate the electric field and turn ON per each of exhausted ink droplets, the method does not require any instrument switching high voltage but may use a simple high voltage source for generating electric fields. Further, it is not necessary to separate an electric field to be added to a nozzle from an electric field to be added to an adjacent nozzle, and therefore a distance between nozzles can be made narrow. With respect to a magnitude of the electric field to be given, when an electric field is determined to be a magnitude insufficient to separate an ink droplet, at a time when an ink within the nozzle is at a still position, from the printing head, and when the ink within the nozzle is under a condition of projecting an ink meniscus from a front face of the printing head, the electric field has a sufficient magnitude to separate said ink droplet from the printing head.

This ink droplet selecting method projects the selected ink meniscus from the front face of the printing head. Since a radius of the ink meniscus is small and nearest to an opposite electrode, the projected ink meniscus is accumulated with electric charge, and the accumulated charge is concentrated to an ink having selected a force generated by an electric field. This force overcomes a surface tension of an ink together with pressure of an ink, and separates the selected ink droplets from the ink main body.

The ink droplet selecting means includes ① decreasing the ink surface tension effected with pressure by heat, ② increasing the heat bubbles volume insufficient to cause ink droplets eject, ③ piezo-electricity having alternation in volume insufficient to cause eject ink droplets, and ④ electrostatic extraction using one electrode per each of nozzles. In addition, the ink droplet separating means includes ① proximity (the recording medium proximate the printing head), ② proximity by pressure of vibrating ink, ③ electrostatic extraction, and ④ magnetic extraction.

Including the ink-jet recording system of the electrostatic type enabling to reduce the displacing amount, all ink-jet recording systems hold such a problem that ink viscosity increases or an ink is hardened by vaporization of an ink solvent at a nozzle so that picture drawings are made poor.

So, the ink-jet recording apparatus has an instrument for sealing the nozzle at rest of printing, and another one for clearing the nozzle as requested. For such a problem, JP-A-11-192732 (the term "JP-A" as used herein means an "unexamined published Japanese patent application") discloses a method of ejecting an ink periodically for preventing the recording head from an ink clogging, irrespective of drawing pictures. Further, JP-A-2000-127417 discloses a technology concerned with a cleaning method of the nozzle. The ink to be used to the ink-jet recording system much contains, owing to problems as above mentioned, a water based solvent or an organic solvent containing dye or pigment as a coloring material for lowering the ink viscosity and particle concentration.

In these ink-jet recording systems, thereby, blur appears in drawn images, and it is difficult to form images of high quality and high resolution, and it takes a long time for drying the image forming parts, so that it is difficult to heighten productivity.

On the other hand, for accomplishing an ink-jet recording system being less blur in images, fast at drying speed and of high quality and high productivity, an ink, particles of which are dispersed in a solvent is disclosed in Japanese Patent 3,000,672 and JP-A-2000-63723. For lessening blur of ink images and accelerating a drying property, it is effective to increase the concentration of particles and decrease the concentration of solvent.

However, if applying such an ink of increasing the concentration of particle and decreasing the concentration of solvent to conventional ink-jet recordings, an ink clogs at a nozzle to hinder a good image drawing.

For settling this problem, JP-A-8-142331 describes an ink-jet recording apparatus being less blur in images, fast at drying speed and of high quality and high productivity. This is composed to use an ink of coloring materials electrically charged to a predetermined polarity and dispersed in a solvent, and regulate flowing of the coloring material component in an ink by force of an electric field so as to condense the coloring material component, and an ejecting instrument ejects the condensed coloring material component to the recording medium by the force of electric field.

This apparatus is further provided with a removing instrument in which, being based on a condensing polarity at a downstream in an ink sending direction of a pair of condensing electrodes, voltage of the same polarity as a charged polarity of the coloring material is applied to a condensing electrode at an upstream of the ink sending direction, so that the coloring material component remaining between said pair of condensing polarities is sent to the downstream in the ink sending direction for removing the remaining coloring material component.

There is further provided a recovering device for recovering the ink, the coloring material component of which is condensed by a condensing instrument, through a recovering inlet located nearly the condensing electrodes.

But, this ink-jet recording apparatus has a fatal defect that since this ink-jet recording apparatus ejects an ink by the electric field, a strong electric field is necessary, so that if making the strong electric field, since interference of the electric fields occurs accordingly between adjacent electrodes, the adjacent electrodes must be separated at some degree, thus the channel density cannot be made large.

A further defect is that when ejecting the coloring material component condensed by the condensing means, since the whole of the condensed coloring material component is ejected by the condensing means, a concentration does not go up as desired depending on conditions.

The removing instrument of the residual coloring material component is for removing the coloring material component remaining between the condensing electrodes, but cleaning thereby is done only at the inside of the nozzle, and the residual coloring material component at a front end of the nozzle contacting an air cannot be removed.

SUMMARY OF THE INVENTION

This invention has been established, noticing the above mentioned problems, and it is accordingly an object of the invention to offer an ink-jet recording apparatus ejecting an ink by use of a piezoelectric element which is less blur in images, fast at drying speed and of high quality, enabling to make an image resolution large and high productivity.

For accomplishing the object, an invention of the ink-jet recording apparatus described in a first aspect of the invention is an image forming apparatus using an ink, electrically charged particles of which are dispersed in a solvent for ejecting ink droplets by means of a piezoelectric jet typed ink jetting head (called as "electric field jetting head" hereafter), characterized by providing ink-sending means for sending an ink to the jetting head; particle distribution-controlling means for controlling distribution of particles concentration in said ink within the jetting head; image-receiving sheet supporting-transporting means for supporting and transporting the image-receiving sheet for receiving flying ink droplets ejected from the jetting head; and accelerating electric field-forming means for forming an electric field accelerating speed of the flying ink droplets.

Another invention described in a second aspect of the invention as set forth in the first aspect is characterized by providing ink recovering means for returning an ink from the jetting head.

A further invention described in a third aspect of the invention as set forth in the first or second aspect is characterized by ejecting substantially only a solvent carrier by use of the particle distribution-controlling means after finishing an image recording or with a cleaning mode.

A still further invention described in a fourth aspect of the invention as set forth in the first aspect is characterized by providing the nozzle of the jetting head only in the vicinity of a densest location in a coloring material concentration distribution formed by the particle distribution controlling means.

Namely, according to the invention, since an ink is ejected by the piezoelectric element, no interference of the electric field with an adjacent channel exists and the nozzle can be formed at high density.

Further, by accelerating speed of the flying ink droplets by the accelerating electrode, a distance between the jetting head and the image-receiving sheet can be broadened, enabling to improve a landing precision of the ink droplet.

The particle concentration in the ink droplet to be ejected is heightened by heightening, at recording images, the particle concentration near the nozzle by the means controlling the particle distribution within the jetting head, and after recording images the particle concentration near the nozzle is decreased, and the nozzle can be cleaned by ejecting substantially only the solvent. As a result, it is possible to offer the ink-jet recording apparatus being less blur in images, fast at drying speed and of high quality, and high productivity.

Figure 1:
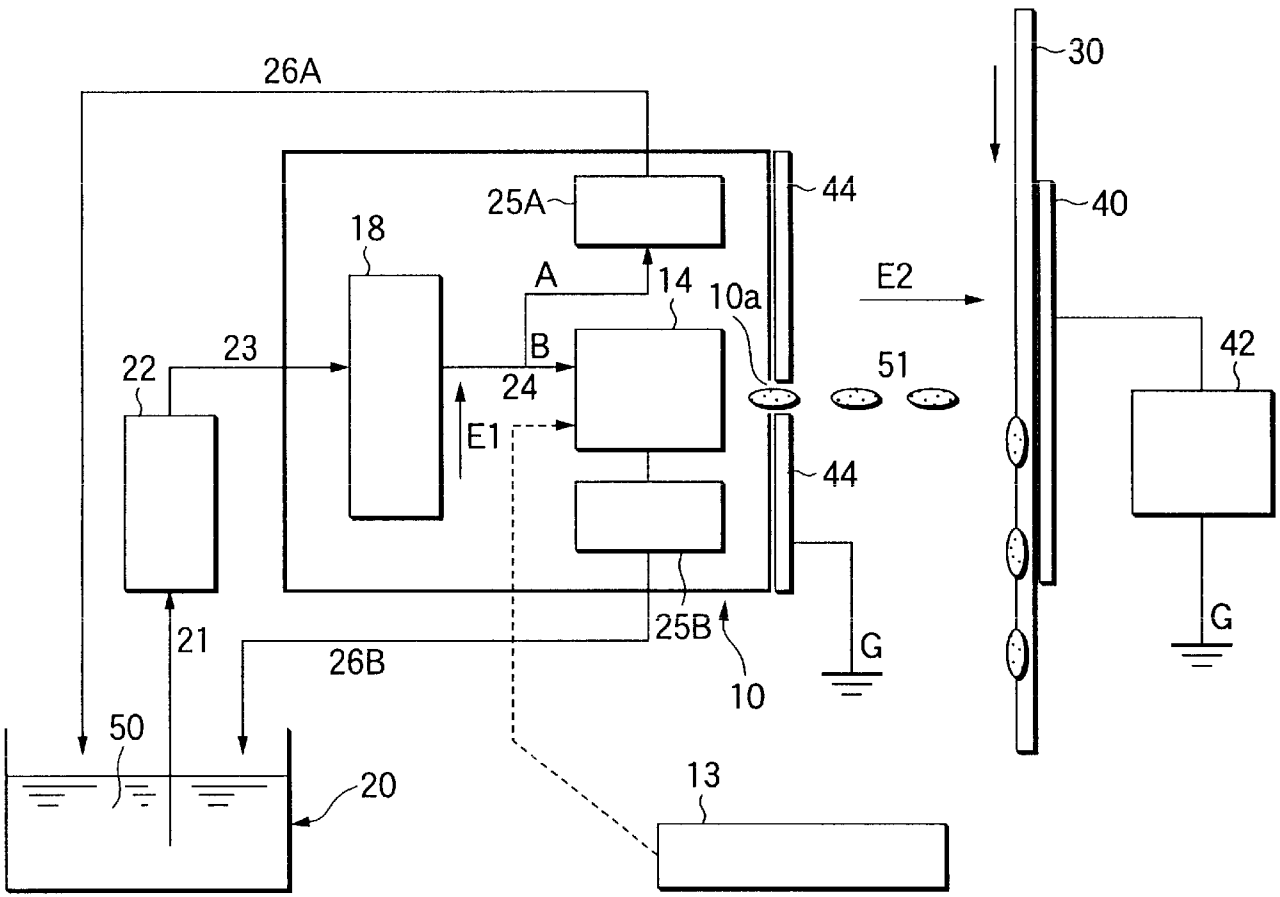
FIG. 1 shows a principle drawing of a first embodiment of the invention.

In the drawings, reference numeral 10 designates the jetting head, 10*a* shows the nozzle, 10*b* is an ink flowing path regulating member, 12 is a concentration bias voltage regulating device (electric field controlling means), 13 is jet signal issuing means, 14 is ink jetting means (PZT), 18 is a concentration distribution controlling electrode, 20 is an ink tank, 21 is a pipe, 22 is liquid sending means, 25 is recovering means, 26 is a return pipe, 30 is an image-receiving sheet, 42 is an accelerating bias voltage controlling device, 44 is an accelerating bias electrode, 50 is an ink, and 51, 51' are ink droplets.

DETAILED DESCRIPTION OF THE INVENTION

The invention will be explained in detail, referring to the attached drawings.

FIG. 1 shows the principle drawing of the first embodiment of the invention.

In FIG. 1, the ink-jet recording apparatus continuously sends an ink 50 from the ink tank 20 supporting an ink 50 via the pipe 21 by the liquid sending instrument 22 and via the pipe 23 to the jetting head 10. The ink to be used is such an ink whose particles colored with a pigment or a dye are dispersed in a solvent. The particles used herein are in advance electrically charged, and not-yet-charged particles may be charged by a charging device until reaching the nozzle 10*a* of the jetting head 10. It is also sufficient to use particles charged by irradiating a light and generate charging by an irradiation device.

The jetting head 10 is formed with the nozzle 10*a* in an ink sending course, while the ink jetting means 14 is provided at a location in opposition to the nozzle 10*a* in the jetting head 10. The ink jetting means 14 is PZT (a piezoelectric element), and an electric signal based on an image data signal is applied by a jet signal issuing device 13. By applying the electric signal to PZT 14, PZT 14 is warped and ejects the ink in the jetting head 10 from the nozzle 10*a*.

Figure 2:
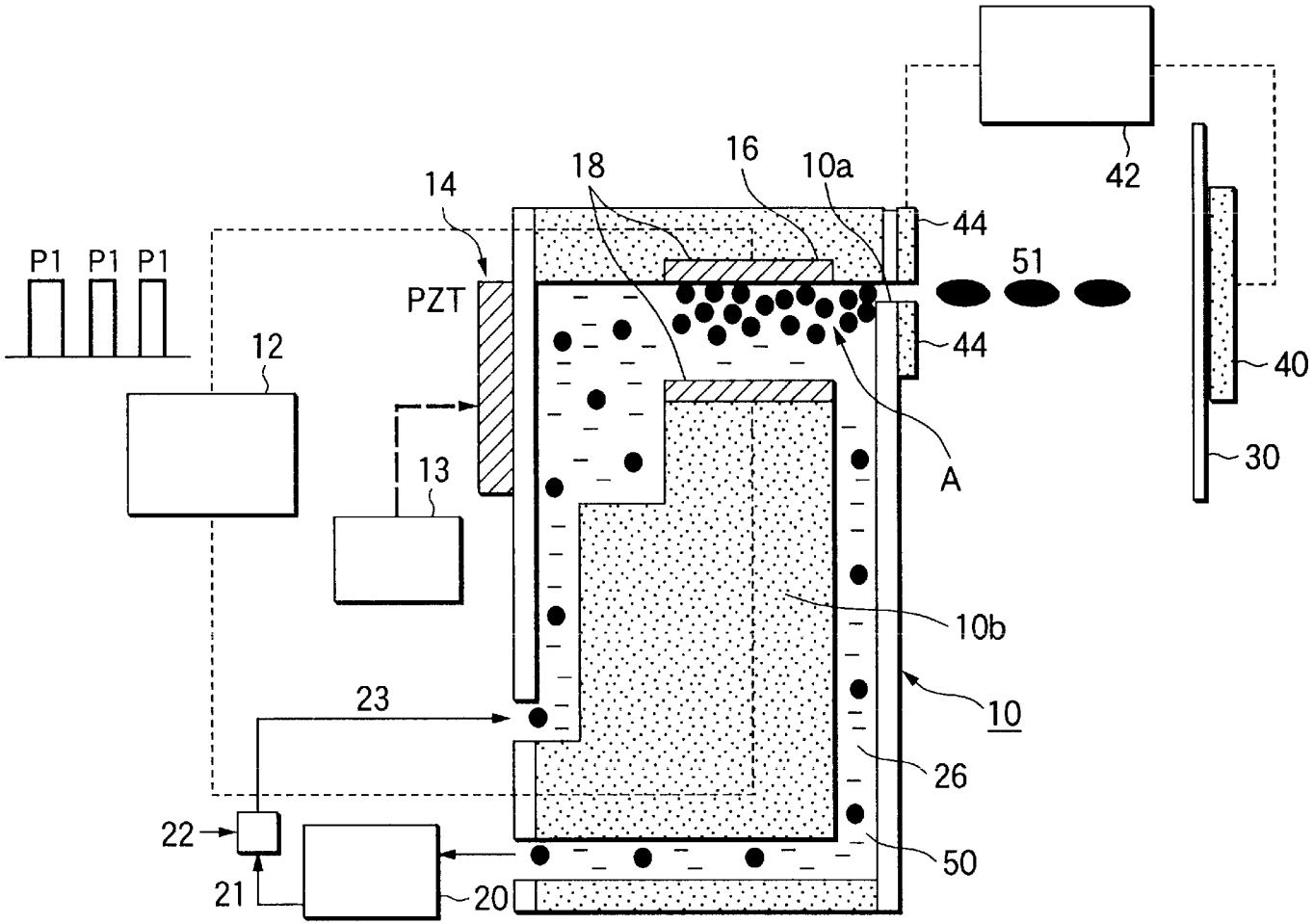
FIG. 2 is a schematically cross sectional view of the ink-jet recording apparatus embodying the principle drawing of FIG. 1.

In the jetting head 10, the concentration distribution controlling electrode 18 is furnished as a concentration distribution forming means for controlling the particle concentration, to which voltage is applied by the concentration bias voltage controlling apparatus (12 of FIG. 2). When forming an image, the concentration distribution controlling electrode is applied with such voltage of forming the electric field E1 in a direction where particles move nearly the nozzle 10*a* by the concentration bias voltage control apparatus. Under a condition where the particle concentration near the nozzle 10*a* is high, the ink 50 is ejected by PZT 14 as the above mentioned ink jetting means.

When the ink 50 is continuously sent to the jetting head 10 by the liquid sending means 22 and is ejected by PZT 14, a major part of particles in the ink 50 and a small amount of the solvent are ejected as ink droplets 51, and the remaining particles and solvent are returned to the ink tank 20 through the return pipe 26B by the recovering means 25B. On the other hand, the ink 50 sent to the jetting head 10 but not ejected is recovered, as having an initial concentration, to the ink tank 20 through a return pipe 26A by a circulation means 25A. Herein in FIG. 1, for showing that the not ejected ink (an original concentration) and the ejected and remaining ink (a low concentration) are different, the ink recoveering means and the returning pipe are shown by dividing into two systems of 25A and 25B as well as 26A and 26B, but actually, the ink recovering means 25 and the returning pipe 26 are the same one.

When forming images, the image-receiving sheet 30 is moved under a condition where it is fixed by an instrument (for example, a recording drum, a flat plate or the like) of fixing or moving a position of the image-receiving seat 30. With respect to the moving image-receiving sheet 30 (in FIG. 1, it moves from an upper side in an arrow direction to a lower side), while a main scanning of a head is being performed appropriately, the ink droplets 51 are ejected , whereby an image is formed on the image-receiving sheet 30.

At the rear side of the image-receiving sheet 30, an accelerating electrode 40 is furnished, so that voltage is applied by an accelerating bias voltage controlling device 42 between the accelerating electrode 44 furnished to the nozzle 10*a* and the accelerating electrode 40. Keeping the voltage applied by the accelerating bias voltage controlling device 42 between the accelerating electrode 44 furnished to the nozzle 10*a* and the accelerating electrode 40, the electrically charged ink droplets 51 ejected from the nozzle 10*a* are accelerated by the accelerating electrodes 40, 44 and land on the image-receiving sheet 30.

The merit of this accelerating means is that thick or uneven receiving sheet is usable and receiving sheet jamming is less. So in the case of using only thin receiving sheet, the accelerating means are unnecessary.

FIG. 2 is the schematically cross sectional view of the ink-jet recording apparatus embodying the principle drawing of FIG. 1. In FIG. 2, reference numeral 10 designates the jetting head of the ink-jet recording apparatus, and the nozzle 10*a* is located at a right upper part, and PZT 14 is disposed at an opposite side (a left upper part) thereto, to which an electric signal is applied in accordance with the image data signal from the jet signal issuing device 13.

The interior of the jetting head 10 is hollow, and at a center, an ink flowing path regulating member 10*b* is placed for regulating flowing paths of the ink 50. That is, the ink 50 is continuously sent from the ink tank 20 via the pipe 21, the liquid sending means 22 and the pipe 23 into the jetting head 10, goes upward on a passage between the left side wall of the jetting head 10 and the left face of the ink flowing path regulating member 10*b*, moves to the side of the nozzle 10*a* from the side of PZT 14, advances on a passage between the right side wall of the jetting head 10 and the right face of the ink flowing path regulating member 10*b*, and goes back to the ink tank 20 through the under side of the ink flowing path regulating member 10*b*.

The ink flowing path regulating member 10*b* is stepwise formed at the upper side, and a distance between the upper side of the jetting head 10 and said upper side is wider at the side of PZT 14 and is narrower at the side of the nozzle 10*a*. At this narrow area, there are equipped the respective concentration distribution control electrodes 18 at the upper inside of the jetting head 10 and at the upper face of the ink flowing path regulating member 10*b*. Between both electrodes 18, a pulse P1 is applied for a predetermined time from the concentration bias voltage controlling apparatus (electric field controlling means) 12 to form the electric field between both electrodes 18. When the ink whose charged particles are dispersed in the solvent passes in the electric field, a voltage pulse is applied such that particles move to the concentration distribution controlling electrode 18 at the side of the nozzle 10*a*.

When the electric signal is applied to PZT 14 under the condition where the particle concentration around the nozzle 10*a* is high, ink droplets 51 of very high particle concentration are ejected from the nozzle 10*a*.

In particular, since the invention furnishes the nozzle 10*a* only in the vicinity of the densest position (in FIG. 2, the upper side electrode 18) in the coloring material distribution between both concentration distribution controlling electrodes 18, the ink droplets 51 of very high particle concentration are ejected from the nozzle 10*a*.

Comparing images when the sent ink 50 was ejected as it was for drawing pictures and when the particle concentration was heightened by controlling the concentration distribution for drawing pictures, the case where the particle concentration was high was less in stain and fast at a drying time.

The concentration bias voltage means applies voltage on and off to the concentration distribution-controlling electrode 18, thereby to gradually move the particle near the nozzle and prevent particles from fixedly electrodepositting to the concentration distribution controlling electrode. Further, by controlling pulse widths, it is possible to control the particle concentration around the nozzle 10*a* and the particle concentration of the ink droplet to be ejected, and improve tone reproduction of drawing pictures.

In the ink-jet image forming apparatus, as the concentration of remaining ink is low, it is better to once return the ink from the jetting head 10 to the ink tank 20 and again bring up nearly to the original concentration in the ink tank 20.

When desired, at the rear side of the image-receiving sheet 30, an accelerating electrode 40 is furnished, so that voltage is applied by an accelerating bias voltage controlling device 42 between the accelerating electrode 44 furnished to the nozzle 10*a* and the accelerating electrode 40. Keeping the voltage applied by the accelerating bias voltage controlling device 42 between the accelerating electrode 44 furnished to the nozzle 10*a* and the accelerating electrode 40, the electrically charged ink droplets 51 ejected from the nozzle 10*a* are accelerated by the accelerating electrodes 40, 44 and land on the image-receiving sheet 30.

Thus, by provision of the accelerating bias electrode 40, a desirable precision of the ink landing position can be made available, though broadening the distance between the jetting head 10 and the image-receiving sheet 30. The merit of this accelerating means is that thick or uneven receiving sheet is usable and receiving sheet jamming is less. So in the case of using only thin receiving sheet, the accelerating means are unnecessary.

The ink to be served is such an ink whose particles are dispersed in the solvent and the particle concentration is preferably about 10 mass % or less. The particles used herein are in advance electrically positively or negatively charged, and the not-yet-charged particles may be charged by a charging device until reaching the nozzle of the jetting head.

The ink employed in the invention will be explained in detail.

The ink to be offer to the invention is composed by dispersing at least particles in the solvent, and particles to be dispersed are sufficient with organic or inorganic particles.

No especial limitation is made to the solvent to used in the invention, but desirable solvents are $10^4$ to $10^{15}$ Ωcm in electric resistivity and 2.0 to 80 in relative dielectric constant. This is because if a proper resistant value is extremely low, the gradient of the particle concentration cannot be hardly maintained, or if the dielectric constant is extremely high, the electric field is moderated by polarization of the solvent, whereby the control of the particle concentration is difficult. Preferably, the viscosity is 1.0 cP to 20 cP and the surface tension is 19 to 74 dyne/cm (mN/m).

Particles to be dispersed in the solvent are good with colored or non-colored particles. In case of using colored particles, the coloring material may be dispersed as the dispersed particles in the solvent, and other dispersed particles may be contained in, for example, resin particles. When containing particles, in a case of a pigment, an ordinary method is to wrap the pigment with a resin material of dispersed resin particles, and in a case of the dye the method is to color the dispersed resin particles and make colored particles.

Available coloring materials are all of pigments and dyes generally used in technical fields of ink compositions or printings.

As the pigments, usable are those used in the general printing technical fields, irrespective of inorganic or organic pigments. Actually, there are, for example, carbon black, cadmium red, molybdenum red, chromium yellow, cadmium yellow, titanium yellow, chromium oxide, pyridian, cobalt blue, ultra marine blue, Prussian blue, cobalt blue, azo pigment, phthalocyanine pigment, quinacridon pigment, isoindolinon pigment, diaxadine pigment, indanthrene pigment, perylene pigment, perynon pigment, thioindigo pigment, quinophthalone pigment, metallic complex pigment, and those conventionally known pigments may be used without especial limitation.

As the dyes, there are azo dye, metallic complex salt dye, naphthaol dye, anthraquinone dye, indigo dye, carbonium dye, quinonimine dye, xanthene dye, arinine dye, quinoline dye, nitro dye, nitroso dye, benzoquinone dye, naphthoquinone dye, phthalocyanine dye, metallic phthalocyanine dye, and those dyes may be used without especial limitation.

These pigments and dyes may be used solely or in combination.

Among inks to be offered to the invention, there are those which may be contained with the dispersed resin particles together with the above mentioned coloring particles for heightening a fixing property of an image after printing.

In the solvents of the invention, including the dispersed colored particles and resin particles, average diameters of these particles are preferably 0.05 to 5 μm, more preferably 0.1 to 1.5 μm, and still more preferably 0.1 to 1.0 μm.

The particle in the ink of the invention is preferably an electrically charged particle of positive or negative polarity. For imparting a charge to the particle, it is accomplished by appropriately utilizing a technique of a developing agent for a wet electro photography. Specifically, this performance is carried out by using the charging agent or other additives described in "Development and Utilization of Recent Electrophotographic Developing System and Toner Materials", pages 139 to 148, "Basis and Application of Electrophotographic Technique" edited by Electrophotographic Associates, pages 497 to 505 (Corona, 1988), or "Electrophotography" by HARAZAKI, Yuzi, page 16 (No. 2) and page 44 (1977).

Desirably charging agent is listed as metallic soaps, organic phosphoric acid or its salts, organic sulfonic acid or its salts, ampholytic surface active agent.

For example, as metallic soaps, enumerated are fatty acid of carbon number being 6 to 24 (for example, 2-ethyl hexynoic acid, 2-ethyl caproic acid, lauryl acid, paramitine acid, elaidic acid, linolenic acid, recinoleic acid, oleine acid, stearin acid, enanthic acid, naphthenic acid, ethylenediamine tetraacetic acid), resin acid, metallic salts of dialkyl succinic acid, alkylphthalic acid, alkylsalicylic acid (metals of metallic ions are Na, K, Li, B, Al, Ti, Ca, Pb, Mn, Co, Zn, Mg, Ce, Ag, Cd, Zr, Cu, Fe, Ba) (for example, U.S. Pat. Nos. 3,411,936 and 3,900,412, JP-A-49-27707, JP-A-51-37651, JP-A-52-38937, JP-A-52-107837, and JP-A-53-123138).

As the organic phosphoric acid or its salts, listed are mono, di, or tri alkyl phosphric acid or di alkyldithio phosphoric acid composed of alkyl group of carbon number being 3 to 18 (described in, for example, U.K. Patents 1,411,739 or 1,276,363) As the organic sulfonic acid or its salts, listed are a long chain aliphatic group sulfonic acid, a long chain alkylbenzene sulfonic acid, dialkylsulfosuccinic acid or its salts (described in, for example, JP-A-47-37128, JP-A-53-123138, JP-A-51-47437, JP-A-50-79640, JP-A-53-30340).

As the ampholytic surface active agent, listed are phospholipid of lecithin, cephalin (described in, for example, JP-A-51-47046), β-alanines containing alkyl group of carbon number being 8 or more (described in, for example, JP-A-50-17642, JP-A-51-47046, JP-A-49-17741), metallic complex component of β-diketons (described in, for example, JP-A-49-27707), copolymer having maleic acid half amido component (described in, for example, JP-A-6-19596, JP-A-6-19595). These electric detecting materials may be used solely or in combination.

The charging agent is desirably used around 0.001 to 1.0 mass parts for 1000 mass parts of the solvent as the carrier liquid.

If desired, some kinds of additives may be added. The total amount of additives is controlled in the upper limit depending on the electric resistivity of the ink, viscosity or surface tension. That is, it is desirable to adjust the upper limit such that the electric resistivity of the ink is around $10^4$ to $10^{15}$ Ωcm, the relative dielectric constant is around 2.0 to 80, the viscosity is around 1.0 to 30 cP, and the surface tension is 19 to 74 dyne/cm (mN/m).

Next, reference will be made to a second embodiment of the invention.

Figure 3:
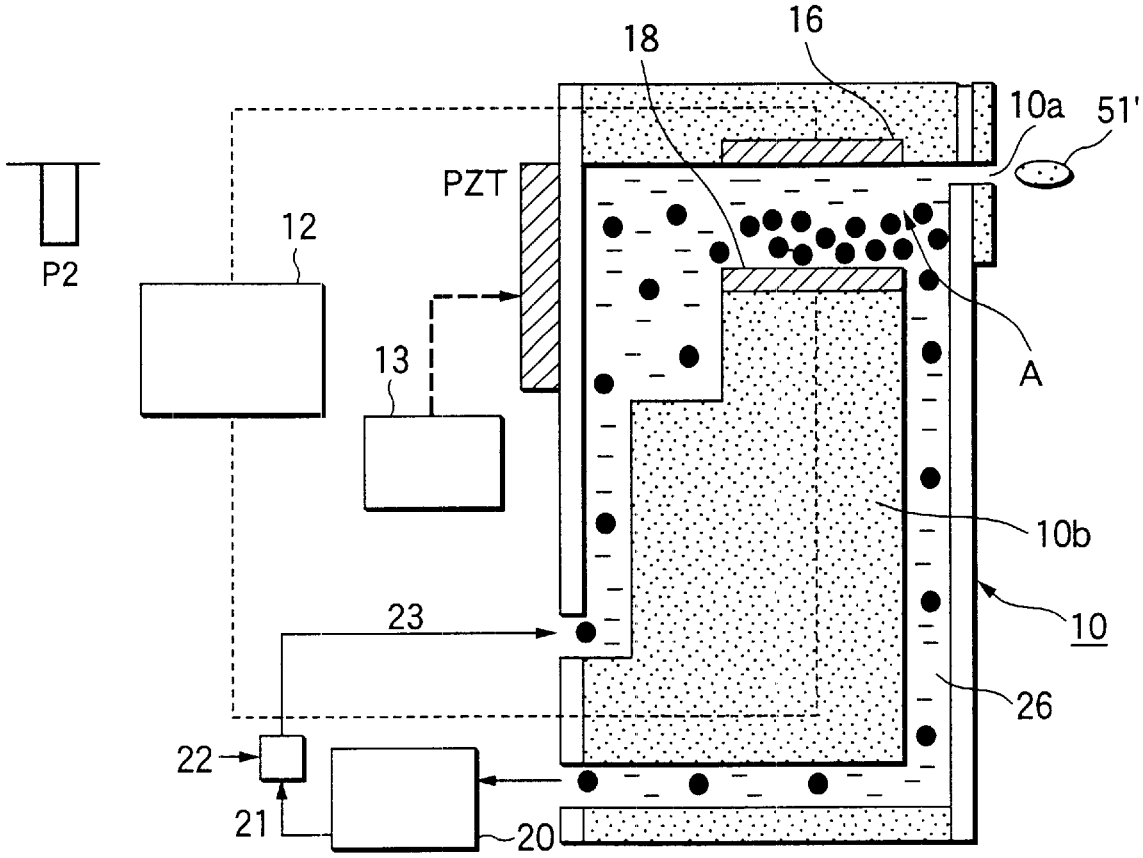
FIG. 3 is a schematically cross sectional view of the ink-jet recording apparatus of the second embodiment of the invention.

FIG. 3 shows the principle drawing of the second embodiment of the invention. An ink-jet recording apparatus of FIG. 3 has the same structure as that of FIG. 2. A difference is a manner of applying the concentration bias voltage to the concentration distribution control electrode 18. In FIG. 2, at recording images, the particle concentration around the nozzle 10*a* is increased and ejected from the nozzle 10*a*, but in FIG. 3, after finishing the recording of images, the particle concentration around the nozzle 10*a* is extremely lowered, and substantially only the solvent carrier is ejected from the nozzle 10*a* for cleaning the front end of the nozzle 10*a*. That is, in FIG. 3, reversing the concentration bias voltage P2 between both concentration controlling electrodes 18 from FIG. 2, when the electrically charged particles pass through the electric field, the particles move to the concentration controlling electrode 18 at the side of the ink flowing path regulating member 10*b*, and reversely the particle concentration around the nozzle 10*a* is extremely lowered. Under this condition, if the electric signal is applied to PZT 14, the ink droplets 51' which is substantially composed of a solvent having very low particle concentration are ejected out of the nozzle 10*a*, thereby cleaning the nozzle.

Thus, after forming images, voltage forming the electric field moving in the direction of the particle being remote from the nozzle, is applied to the concentration distribution control electrode, so that the particle concentration in the ejected ink droplet is low, and only the solvent is ejected to carry out the cleaning at the nozzle, in particular at the front end of the nozzle contacting the air and being easily clogged. As a result, the nozzle can be prevented from the ink clogging.

Further, it is convenient to provide a cleaning mode even during the apparatus is operated, other than just before the apparatus is powered off. Because, a head not ejecting for a long period of time is ready for being clogged by drying, and therefore, substantially only the solvent is ejected from all the nozzles or from nozzles requiring cleaning at appropriate time intervals (that is, a time interval that can prevent the nozzle from drying) by the second embodiment.

According to the invention, for drawing pictures, the particle concentration around the nozzle is increased, and the ink droplets of high particle concentration are ejected. After finishing the forming of images and just before the apparatus is powered off, the particle concentration around the nozzle is lowered and ejected periodically and substantially only the solvent is ejected to clean the nozzle. In short, no nozzle clogging occurs since the nozzles are cleaned by ejecting the carrier dispersed solvent after finishing the work. In addition, since the concentration of the ejected ink can be considerably increased by the particle distribution controlling means, the density of images can be increased accordingly, and blur is less and the drying speed is fast.

The ink landing precision can be improved by the electric field accelerating particles in a vertical direction with an image receiving face. PZT can employ a technique forming the electrode at the interior of the head having a similar structure to that a bubble jet, and so a production is easy, and the image resolution can be made large because of not using electrostatic field.

Thus, according to the invention, it is possible to offer the ink-jet recording apparatus by use of the piezoelectric element being less blur in images, fast at drying speed and of high quality, enabling to make image resolutions large and high productivity.

The entire disclosure of each and every foreign patent application from which the benefit of foreign priority has been claimed in the present application is incorporated herein by reference, as if fully set forth herein.

What is claimed is:

1. An ink-jet image forming apparatus comprising:

a piezoelectric ink jetting head for ejecting ink droplets, the ink comprising electrically charged particles dispersed in a solvent;

ink-supplying means for supplying the ink to the ink jetting head;

particle distribution-controlling means for controlling concentration distribution of the particles in the ink at the ink jetting head; and supporting and transporting means for supporting and transporting an image-receiving sheet that receives flying ink droplets ejected from the ink jetting head.

2. The ink-jet image forming apparatus according to claim 1, which further comprises electric field-forming means for forming an electric field so as to accelerate a fly speed of ink droplets ejected from the ink jetting head to the image-receiving sheet.

3. The ink-jet image forming apparatus according to claim 1, which further comprises ink recovering means for returning the ink from the ink jetting head.

4. The ink-jet image forming apparatus according to claim 3, wherein an ink that does not substantially comprise the particles, is ejected by use of the particle distribution-controlling means after finishing an image recording or in a cleaning mode.

5. The ink-jet image forming apparatus according to claim 3, wherein a nozzle of the ink jetting head is provided in a vicinity of a portion having a highest concentration of the particles formed by the particle distribution-controlling means.

6. The ink-jet image forming apparatus according to claim 2, wherein an ink that does not substantially comprise the particles, is ejected by use of the particle distribution-controlling means after finishing an image recording or in a cleaning mode.

7. The ink-jet image forming apparatus according to claim 2, wherein a nozzle of the ink jetting head is provided in a vicinity of a portion having a highest concentration of the particles formed by the particle distribution-controlling means.

8. The ink-jet image forming apparatus according to claim 1, which further comprises ink recovering means for returning the ink from the ink jetting head.

9. The ink-jet image forming apparatus according to claim 8, wherein an ink that does not substantially comprise the particles, is ejected by use of the particle distribution-controlling means after finishing an image recording or in a cleaning mode.

10. The ink-jet image forming apparatus according to claim 8, wherein a nozzle of the ink jetting head is provided in a vicinity of a portion having a highest concentration of the particles formed by the particle distribution-controlling means.

11. The ink-jet image forming apparatus according to claim 1, wherein an ink that does not substantially comprise the particles, is ejected by use of the particle distribution-controlling means after finishing an image recording or in a cleaning mode.

12. The ink-jet image forming apparatus according to claim 1, wherein a nozzle of the ink jetting head is provided in a vicinity of a portion having a highest concentration of the particles formed by the particle distribution-controlling means.

13. The ink-jet image forming apparatus according to claim 1, wherein the solvent has electric resistivity of from $10^4$ Ωcm to $10^{15}$ Ωcm.

14. The ink-jet image forming apparatus according to claim 1, wherein the solvent has relative dielectric constant of from 2.0 to 80.

15. The ink-jet image forming apparatus according to claim 1, wherein the solvent has a viscosity of 1.0 cP to 20 cP.

16. The ink-jet image forming apparatus according to claim 1, wherein the solvent has a surface tension of 19 dyne/cm to 74 dyne/cm.

17. The ink-jet image forming apparatus according to claim 1, wherein the electrically charged particles have an average diameter of from 0.05 μm to 5 μm.

* * * * *